United States Patent [19]

Asai et al.

[11] Patent Number: 4,458,612

[45] Date of Patent: Jul. 10, 1984

[54] BUTTONHOLE SEWING MACHINE AND METHOD OF BUTTONHOLE FORMATION

[75] Inventors: Yoshimi Asai; Michitaka Takiguchi; Fujio Horie, all of Nagoya, Japan

[73] Assignee: Brother Kogyo Kabushiki Kaisha, Nagoya, Japan

[21] Appl. No.: 530,103

[22] Filed: Sep. 7, 1983

[30] Foreign Application Priority Data

Sep. 21, 1982 [JP] Japan ..... 57-164231
Sep. 29, 1982 [JP] Japan ..... 57-170100

[51] Int. Cl.[3] ..... D05B 3/06
[52] U.S. Cl. ..... 112/158 B; 112/264.1
[58] Field of Search ..... 112/158 B, 158 E, 264.1, 112/437, 65, 66

[56] References Cited

U.S. PATENT DOCUMENTS 4,215,640 8/1980 Coughenour ..... 112/158 B X
4,250,821 2/1981 Miyao et al. ..... 112/158 B
4,343,249 8/1982 Takenoya et al. ..... 112/314 X

*Primary Examiner*—Peter P. Nerbun
*Attorney, Agent, or Firm*—Browdy and Neimark

[57] ABSTRACT

A buttonhole sewing machine for automatically forming a buttonhole including right and left parallel side stitching parts, and another stitching part connected to the side stitching parts. The machine has a switch for detecting front and rear ends of each side stitching part, and is capable of sewing the buttonhole in divided parts on opposite sides of a longitudinal centerline thereof so that the two side stitching parts are stitched in the same work feeding direction. The machine comprises a control circuit generating a feed change signal when the number of stitches being formed in one of the side stitching parts has become equal the total number of stitches of the other side stitching part less a predetermined number, and a feed adjusting circuit for reducing a work feeding increment for a time interval between generation of the change signal and a signal from the switch, to avoid a difference in length between the side stitching parts. The machine is also capable of sewing a buttonhole including a circular stitching part contiguous to the side stitching parts, such that one half of the circular stitching parts is sewn immediately after formation of at least one stitch in the other half of the circular stitching part for avoiding a gap between the two halves.

7 Claims, 6 Drawing Figures

FIG. 1
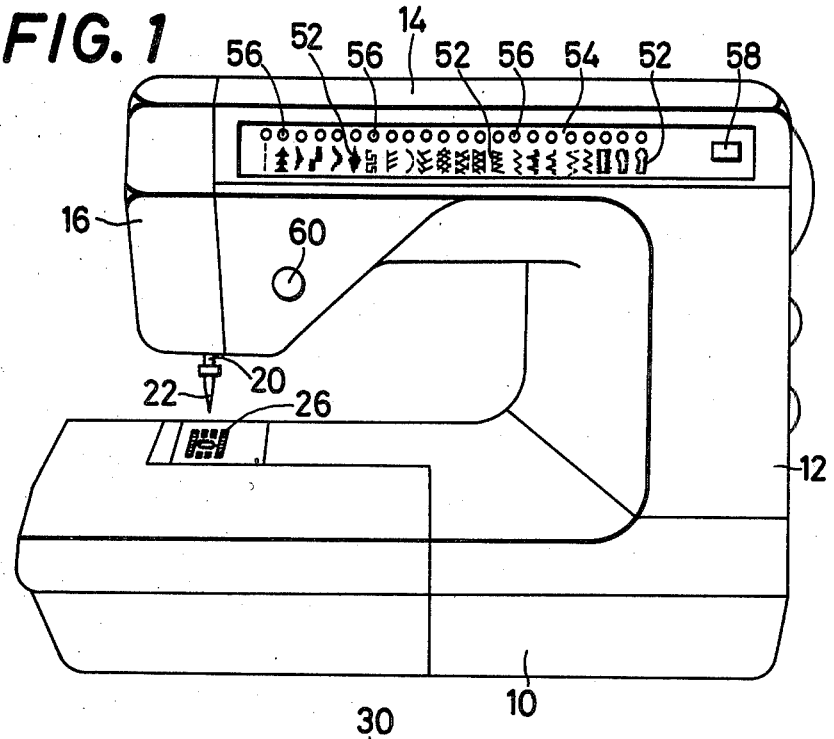
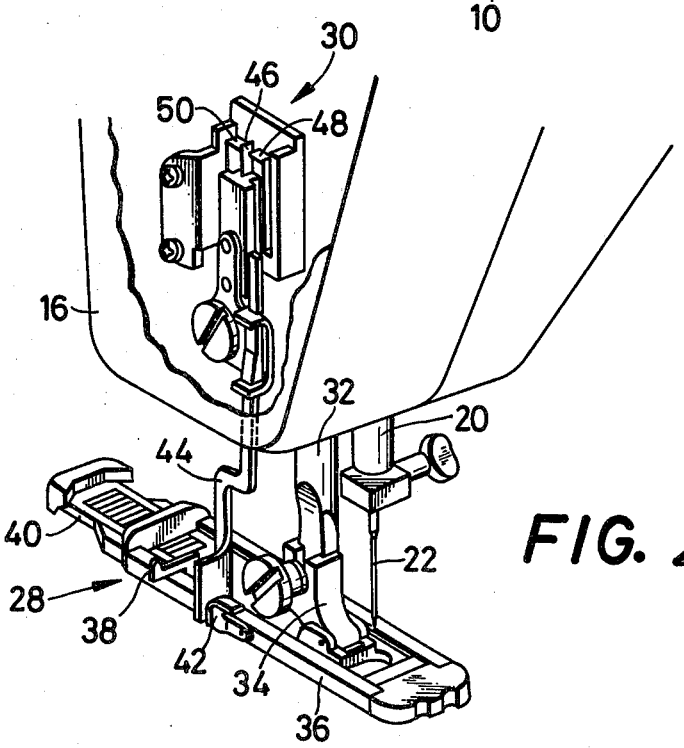
FIG. 2

BUTTONHOLE SEWING MACHINE AND METHOD OF BUTTONHOLE FORMATION

BACKGROUND OF THE INVENTION

The present invention relates to a buttonhole sewing machine capable of forming a buttonhole; more particularly, it is concerned with a sewing machine capable of automatically producing a buttonhole which is formed of a plurality of stitching parts including spaced-apart parallel rows of stitches located on right and left sides of a centerline of the buttonhole pattern.

There have been proposed various types of sewing machines for automatically sewing a buttonhole which have right and left side stitching parts in spaced-apart parallel rows and another stitching part connecting those parallel spaced-apart stitching parts at one end thereof. It has also been proposed, in the art of buttonhole formation, to reduce to an irreducible minimum extent a difference in feed distance of a work material or fabric when the fabric is fed in opposite directions, forward and reverse directions for sewing the right and left side stitching parts, that is, to establish the identical feeding conditions of a work material for both right and left side stitching parts. An example of such technique is disclosed in U.S. Pat. No. 4,159,685. While the technique as disclosed therein is effective in forming a buttonhole with an improved appearance, it is recognized that the formation of a buttonhole is influenced by various factors other than the feeding direction of the work material. Such other factors include a variation in detected positions of front and rear ends of each side stitching part which are sensed by a detector switch in cooperation with a buttonhole presser foot. In a buttonhole sewing with such arangement, however, it is generally unavoidable that positions at which the position detector switch is actuated at said front and rear ends on the work material, are varied more or less due to shrinkage of work material and an overrun of the buttonhole presser foot device. This variation in the actuating position of the detector will cause a variation or difference in length between the right and left side stitching parts which define a substantial length of the buttonhole. As a result, it has been found that said another stitching part is separated from the end of one of the two side stitching parts while it is suitably contiguous or connected to the other. This disadvantage is apparent particularly when the work material is fed at a high rate for increased sewing efficiency, and may result in spoiling the appearance of the buttonhole and consequently degrading the quality and value of the sewn products.

Further, in the art of sewing a buttonhole such as an eyelet-end buttonhole wherein the right and left side stitching parts are connected or contiguous at one end thereof to a circular stitching part, another drawback has been experienced in addition to the difference in length between the two spaced-apart side stitching parts. More specifically stated, for eliminating a difference in the feed distance of the work material due to different feeding directions, it has been attempted to divide a circular stitching part into two right and left halves and sew the two individual halves independently of each other, rather than continuously form the entire portion of the circular stitching part in the same circumferential direction. With this sewing method of separate formation of the two semicircular halves of a circular stitching part, it is generally unavoidable that the two semicircular stitching parts undergo a slight shrinkage due to tensile forces of threads upon formation of the stitches, whereby there is easily devloped a gap or spacial separation at the interface or connection of the two semicircular stitching parts which are disposed in the respective right and left areas on opposite sides of the longitudinal centerline of the buttonhole pattern. The gap thus developed will degrade the appearance of the buttonhole.

SUMMARY OF THE INVENTION

It is accordingly an object of the present invention which was completed in view of the above described background, to provide a sewing machine and a method for uniformly and neatly forming a buttonhole without a gap present at any connections of plural stitching parts contiguous to one another.

According to the present invention, there is provided a buttonhole sewing machine having (a) stitch forming instrumentalities including a reciprocable needle and a work feeding mechanism, (b) means operating in timed relation with reciprocation of the needle for producing each of stitch signals corresponding to stitches of a buttonhole including a first and a second side stitching part parallel to and spaced from each other, each of the stitch signals including a reference feed signal influencing a feed increment of the work feeding mechanism, (c) a buttonhole presser device including a button size gauging arrangement, (d) switch means adapted to cooperate with the button size gauging arrangement during formation of the buttonhole, the switch means producing two position signals corresponding to a front and a rear end of each of the side stitching parts to define a longitudinal size of said buttonhole, and (e) means for actuating the stitch forming instrumentalities in response to the stitch signals and the two position signals. The buttonhole sewing machine comprises:

means for generating a modified feed signal representative of a feed increment smaller than a feed increment indicated by the reference feed signal related to the side stitching parts;

changeover means operative to change the reference feed signal into the modified feed signal and to provide the actuating means with the modified feed signal;

means for counting first stitches formed in the first side stitching part during a time interval between generations of the two position signals and then counting second stitches formed in the second side stitching part after generation of one of the two position signals; and control means for generating a coincidence signal when a count of the second stitches of the counting means has become equal to the already counted total number of the first stitches less a predetermined number, and for operating the changeover means during a time interval between generation of the coincidence signal and subsequent generation of the other position signal.

According to the invention, there is also provided a method of forming a buttonhole including a first and a second side stitching part parallel to and spaced from each other, on a sewing machine having the previously described (a) stitch forming instrumentalities, (b) stitch signal producing means, (c) buttonhole presser device, (d) switch means and (e) actuating means. This buttonhole forming method comprises the steps of:

measuring the first length of the first side stitching part formed during a time interval between the two position signals;

measuring the second length of the second side stitching part formed after generation of one of the two position signals; and providing the actuating means with a modified feed signal in place of the reference signal during a time interval from the moment when the second length measured during formation of the second stitching part has become equal to the measured first length less a predetermined length, until the other position signal is produced after the beginning of the time interval, the modified feed signal being indicative of a feed increment smaller than a feed increment indicated by the reference feed signal related to the side stitching parts.

With the above arrangement for buttonhole formation wherein one of the two side stitching parts is sewn after the other side stitching part is sewn, the feed increment of the work material is reduced during the sewing of said one side stitching part when the number of stitches formed therein has reached a value which is smaller by a predetermined number than the total number of stitches formed in said other side stitching part, so that the feed increment for the remaining stitches to be formed until the position detector switch is actuated, is sufficiently lower than the feed increment used for the slready formed stitches, i.e., the work feeding speed is reduced to a sufficiently low level before the position detector switch is actuated through engagement with a stop member or actuating tab of the presser foot device at the end of the sewing of said one of the side stitching parts. Thus, the variation in actuating position of the detector switch is restrained or minimized to within a range of a feed increment of a comparatively small distance because of a low rate of feeding of the work material upon actuation of the detector switch, whereby the variation or difference in length of the right and left spaced-apart stitching parts is reduced to an appreciable extent. As a result, another stitching part such as a bar tacking part contiguous to the already sewn side stitching part can be suitably connected to the end of the other side stitching part with a high accuracy of positioning of the contiguous parts relative to each other, whereby the buttonhole can be formed with a uniform balanced appearance and a high stitching quality as a whole.

In accordance with another aspect of the present invention, there is provided a method of forming a buttonhole which includes two zigzag stitching parts in spaced-apart parallel rows of zigzag stitches placed in first and second areas on opposite sides of a longitudinal centerline of the buttonhole pattern, an end stitching part connected to one end of each of the zigzag stitching parts, and a circular stitching part connected to the other end of each of the zigzag stitching parts. The method comprises the steps of:

(a) forming a straight stitching part in a direction from said one end toward the other end in the first area;

(b) forming at least one stitch in one half of the circular stitching part in the second area;

(c) forming the other half of the circular stitching part and one of the zigzag stitching parts connected thereto in the first area;

(d) forming a straight stitching part in said direction in the second area;

(e) forming at least one stitch in said other half of the circular stitching part in the first area; and (f) forming said one half of the circular stitching part and the other half of the zigzag stitching parts connected thereto in the second area.

In the above method of the invention, the two right and left side stitching parts symmetrical to each other with respect to the centerline of the buttonhole pattern are sewn in the same feeding direction of a work material such that they are connected to the circular stitching part or two semicircular halves thereof, whereby the formation of those two side stitching parts is implemented with the same work feeding efficiency. Thus, the right and left side stitching parts are formed of a substantially equal number of stitches (with a substantially equal stitch density), with a result of providing the buttonhole with a good appearance which is balanced between the right and left sides thereof.

It is noted that the above described lines of stitches formed without bight displacements are intended to determine the substantial length of the buttonhole and therefore may be formed of triplicate stitches or chainstitches as well as straight stitches.

In this description, the term "side stitching part" represents that portion of a buttonhole a length of which is determined through actuation of a position detector which cooperates with a buttonhole presser device to detect the position of a work material.

Further, the buttonhole to be sewn according to the present method of said another aspect of the invention is not limited to an eyelet-end buttonhole but may be of other kinds so long as it has a circular stitching part connecting the spaced-apart side stitching parts at said other end thereof.

BRIEF DESCRIPTION OF THE DRAWINGS

The above and other related objects and features of the invention will become apparent from the following description of embodiments with reference to the accompanying drawings in which:

FIG. 1 is a schematic illustration of one embodiment of a buttonhole sewing machine of the present invention;

FIG. 2 is a perspective view of a buttonhole presser device and a paddle switch attached to a head of the sewing machine of FIG. 1;

DETAILED DESCRIPTION OF THE PREFERRED EMBODIMENTS

Figure 3:
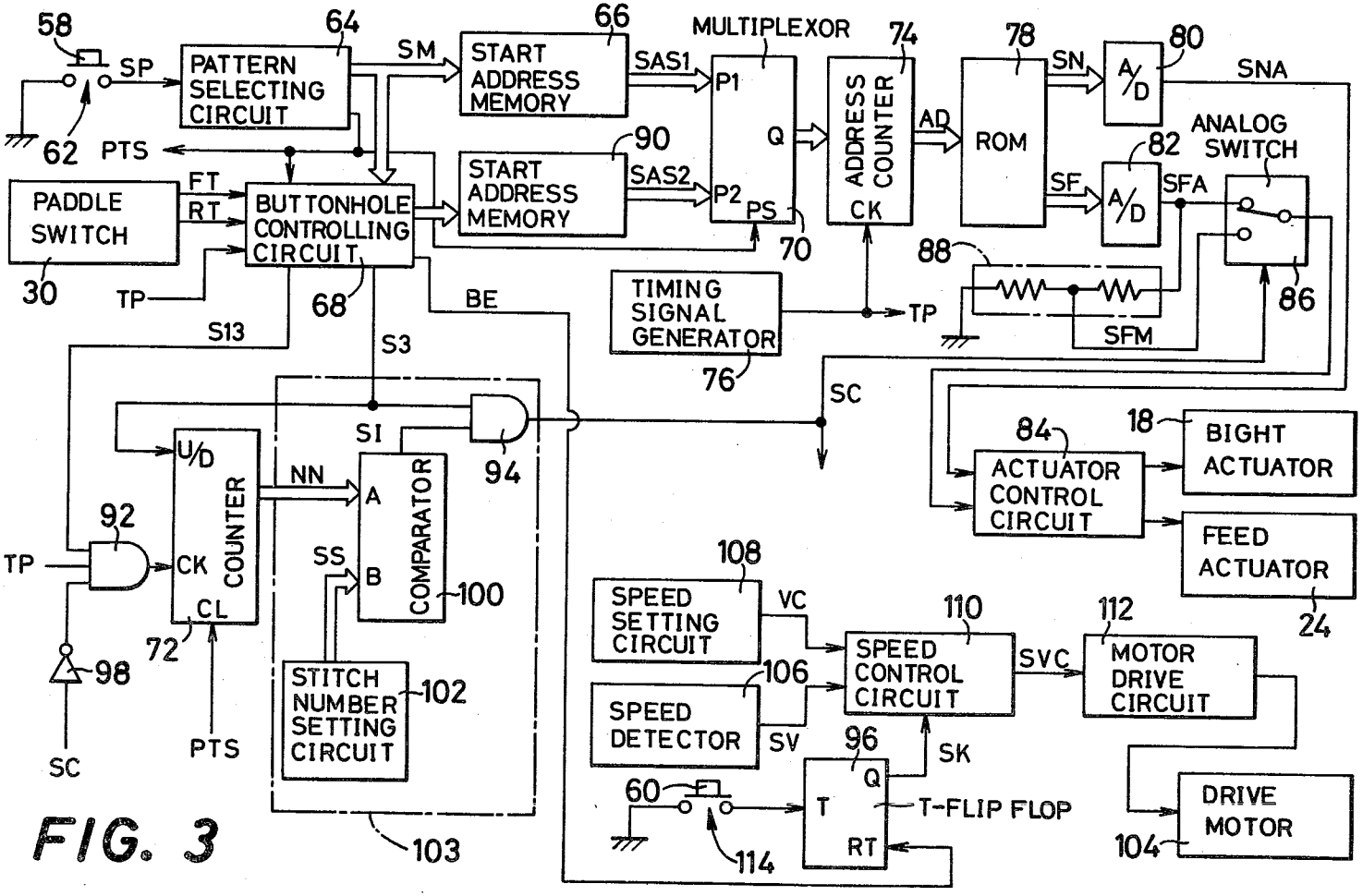
FIG. 3 is a block schematic diagram of an electric circuit provided on the sewing machine of FIG. 1.

The present invention will be described in more detail referring to the accompanying drawings illustrating preferred embodiments of the invention.

There is provided in FIG. 1 a schematic illustration of a sewing machine having a bed 10 from which a standard 12 rises so as to support a bracket arm 14 at its one end. The bracket arm 14 extends horizontally to support at its other end a head 16 which carries at its lower part a needle bar 20 which is reciprocated endwise or vertically by a drive motor 104 discussed later. Further, the needle bar 20 is jogged sidewise or laterally by a bight actuator 18 discussed later. The needle bar 20 holds a needle 22 which is movable endwise toward a feed dog 26 disposed on the bed 10. The feed directions and increment of the feed dog is adjusted by a feed adjuster which is driven by a feed actuator 24 discussed later. The needle 22 and the feed dog 26 cooperate to form stitches in a desired pattern on a work material or fabric.

For sewing a buttonhole on the sewing machine described above, a buttonhole presser device 28 and a paddle switch 30 actuated the former are attached to the head 16 as shown in FIG. 2. Described in more detail, the buttonhole presser device 28 comprises: a presser foot 34 which is attached to a presser bar 32 provided on the head 16 adjacent the needle bar 20; a work engaging shoe 36 attached to the presser foot 34 for relative movements with respect to the presser foot 34 in the work feeding direction; and a button size gauging arrangement 40 which is partially fitted in a rear portion of the frame 36 for sliding movements longitudinally of the shoe 36 and which includes an actuating tab or trip dog 38 whose position is changeable according to the size of a button inserted in the button size gauging arrangement 40. The paddle switch 30 comprises: a lever 44 which is pivotally supported on the head 16 such that the lower end is positioned between the trip dog 38 and another actuating tab or trip dog 42 fixed to the shoe 36 in spaced relation with the trip dog 38; a common contact 46 fixed to the upper end of the lever 44 in an electrically insulated manner; and a pair of stationary contacts 48, 50 which are disposed on the head 16 with electric insulation therefrom such that the common contact 46 is interposed between the stationary contacts 48, 50 in mutually spaced relation with one another. While the work engaging shoe 36 is fed rearwardly (away from the operator) together with the work material, the lever 44 is pivoted by the trip dog 42 and the common contact 46 comes into contact with the stationary contact 48 to close the paddle switch 30, whereby the paddle switch 30 generates a FRONT END position signal FT representative of the front end or edge of side stitching parts of a buttonhole to be sewn. On the other hand, the forward movement of the work engaging shoe 36 (toward the operator) will cause the trip dog 38 to pivot the lever 44 and thereby effect a closure of the paddle switch 30 through contact of the common contact 46 with the stationary contact 50. In this instance, the paddle switch 30 generates a REAR END position signal RT representative of the rear end or edge of the side stitching parts.

Referring back to FIG. 1, the bracket arm 14 has on its front surface: a display plate 54 bearing a plurality of pattern indicia 52 which represent respective stitch patterns available on the sewing machine; light emitting diodes or LEDs 56 disposed adjacent the pattern indicia 52 to represent the same; and a pattern selecting button 58 which is depressed to selectively and sequentially illuminate the LEDs 56 so that a desired one of the stitch patterns is selected on the sewing machine. The head 16 further has a start-stop switch 60 on its front lower part. This switch 60 is an alternate-action switch each depression of which causes the sewing machine to be started and stopped alternately.

The sewing machine arranged as discussed hereinbefore is provided with an electric circuit as shown in FIG. 3, wherein there is shown a switch 62 which, upon each depression of the pattern selecting button 58, is closed feeding a SELECT OPERATION signal SP to a pattern selecting circuit 64. This pattern selecting circuit 64 includes a counter which counts the SELECT OPERATION signals SP, a decoder for selective illumination of the LEDs 56 according to a count of the counter, and another decoder which produces a BUTTONHOLE SELECTION signal PTS when the current count represents one of three different buttonhole patterns. The pattern selecting circuit 64 generates, according to its count, a PATTERN CODE signal SM which represents a currently selected stitch pattern. This signal SM is fed to a start address memory 66 and to a buttonhole controlling circuit 68. The BUTTONHOLE SELECTION signal PTS is applied to the buttonhole controlling circuit 68, and to a multiplexor 70 and a counter 72, both referred to later. The start address memory 66 produces a START ADDRESS signal SAS1 corresponding to the selected stitch pattern, and the signal SAS1 is applied to an address counter 74 through the multiplexor 70 in order to retrieve a series or group of stitch data for sewing the selected stitch pattern. Normally, the multiplexor 70 selects its input port P1 and allows the output signal SAS1 from the start address memory 66 to pass therethrough. In the event the multiplexor 70 receives the BUTTONHOLE SELECTION signal PTS, however, the multiplexor 70 selects its another input port P2.

The address counter 74 which receives from a timing signal generator 76 TIMING signals TP synchronous with rotary movements of a machine spindle not shown, counts the TIMING signals TP as well as the START ADDRESS signals SAS1 and supplies to a read-only-memory or ROM 78 ADDRESS signals AD corresponding to the counts of the TIMING signals TP. The address counter 74 receives the START ADDRESS signal SAS1 each time a new stitch pattern is selected by depression of the pattern selecting button 58. The START ADDRESS signal SAS1 is again applied to the address counter 74 upon generation of an end signal at the end of a series of stitch data from the ROM 78.

The ROM 78 stores multiple groups of stitch data corresponding to the respective stitch patterns to be sewn on the sewing machine and as it receives the ADDRESS signals AD, supplies D/A (digital-analog) converters 80 and 82 with successive stitch data each consisting of bight data SN and feed data SF which define the position of each stitch formed in the selected pattern. The D/A converter 80 converts the bight data SN into a voltage of a magnitude corresponding to the value of the bight data, and applies a BIGHT signal SNA to an actuator control circuit 84 for amplification. The amplified BIGHT signal SNA is fed to the bight actuator 18 whereby the bight position of the needle 22 is determined. Similarly, the D/A converter 82 converts the FEED data SF into a voltage of a magnitude corresponding to the value of the FEED data, and applies a FEED signal SFA to the actuator control circuit 84 through an analog switch 86. The actuator control circuit 84 which also serves as a feed control circuit, applies the FEED signal SFA to the feed actuator 24 which in turn drives the feed adjuster not shown. Between the D/A converter 82 and the analog switch 86, there is provided a voltage divider 88 which applies a substantially half fraction of the output voltage of the D/A converter 82 to another input of the analog switch 86. Normally, the output SFA, i.e., reference FEED signal SFA from the D/A coverter 82 is fed directly to the analog switch 86 and to the actuator control circuit 84. However, when a FEED CHANGE signal SC is received by the analog switch 86, a modified FEED signal SFM divided from the reference FEED signal SFA by the voltage divider 88 is fed to the actuator control circuit 84 through the analog switch 86. Thus, the voltage divider 88 serves as means for generating the modified FEED signal SFM, and the analog switch 86 serves as changeover means for converting the reference FEED signal SFA into the modified FEED signal SFM.

The previously indicated buttonhole controlling circuit 68 receives the FRONT END and REAR END signals FT and RT from the paddle switch 30, and the TIMING signals TP from the timing signal generator 76. The buttonhole controlling circuit 68 judges, based on the received PATTERN CODE signals SM, as to which one of the three buttonhole patterns has been selected. To initiate each sewing step of the selected buttonhole pattern, the buttonhole controlling circuit 68 feeds appropriate signals, according to the FRONT END, REAR END and TIMING signals FT, RT and TP, to a start address memory 90 which is provided exclusively for buttonholing operations. While the BUTTONHOLE SELCTION signal PTS from the pattern selecting circuit is present, the multiplexor 70 selects its input port P2 so that a START ADDRESS signal SAS2 presented from the start address memory 90 is fed to the address counter 74 through the multiplexor 70. In addition, the buttonhole controlling circuit 68 supplies an AND gate 92 with signals to indicate that predetermined specific steps of a buttonhole sewing cycle are currently executed, e.g., signal S13 which indicates the execution of first and third steps of the buttonholing cycle. Further, the circuit 68 supplies the counter 72 and another AND gate 94 with a signal of high level which indicate that one of the predetermined steps is being executed, e.g., signal S3 indicating the execution of the third step. Further, the same circuit 68 applies to a T flip-flop 96 an END CODE signal BE which represents that the last step of the buttonhole sewing cycle has been completed.

The AND gate 92 receives the FEED CHANGE signal SC which is fed thereto through an inverter 98, and the TIMING signals TP which are fed to the counter 72 during execution of the predetermined buttonhole sewing steps, e.g., first or third step, while the FEED CHANGE signal SC is not present. The counter 72 is an up-down counter which is designed to count up while the signal S3 is absent, and count down while the signal S3 is present. More specifically stated, the counter 72 counts the number of stitches formed in the first step by counting the TIMING signals TP and subtracts, from the total stitch number already counted in the first step, the number of the TIMING signals TP being counted in the third step. The counter 72 is cleared when it receives the BUTTONHOLE SELECTION signal PTS.

A STITCH NUMBER signal NN which represents the content of the counter 72 is applied to a comparator 100. In the meantime, the comparator 100 receives from a stitch number setting circuit 102 a STITCH NUMBER signal SS representative of the number of stitches for which an adjusted feed increment is used. The comparator 100 compares the preset stitch number with the number of stitches left unsewn in the third step, and applies an COINCIDENCE signal SI to the AND gate 94 when these two numbers have become equal to each other. When the AND gate 94 have received both the signal S3 and the COINCIDENCE signal SI, it generates the FEED CHANGE signal SC which is applied to the analog switch 86 and the inverter 98. Thus, the stitch number setting circuit 102, comparator 100 and the AND gate 94 constitute control means 103 which produces the FEED CHANGE signal SC.

The sewing machine is further provided with a speed detector 106 which detects a rotating speed of the drive motor 104, and with a speed setting circuit 108 which is used to designate the rotating speed of the drive motor 104. The speed detector 106 and the speed setting circuit 108 supply a speed control circuit 110 with a SPEED DETECTION signal SV representative of an actual rotating speed of the drive motor 104, and a SPEED COMMAND signal VC representative of a speed designated by the speed setting circuit 108, respectively. The speed control circuit 110 produces a SPEED CONTROL signal SVC which is calculated so that the actual rotating speed of the drive motor 104 is identical to a designated speed represented by the SPEED DETECTION signal VC. The SPEED CONTROL signal SVC is fed to a motor drive circuit 112 which supplies the drive motor 104 with electric power corresponding to the SPEED CONTROL signal SVC. In this arrangement, therefore, the speed of the drive motor 104 is controlled so that the actual rotating speed is kept equal to the selected speed commanded by the SPEED DETECTION signal VC, regardless of a variation in load applied to the drive motor 104.

While a MOTOR START signal SK is present, the speed control circuit 110 applies the SPEED CONTROL signals SVC to the motor drive circuit 112 to control the rotating speed of the drive motor. When the MOTOR START signal SK is not present, no SPEED CONTROL signals SVC are produced and thus the drive motor 104 is stopped. The MOTOR START signal SK is fed to the speed control circuit 110 through the T flip-flop 96 which is placed in the SET and RESET states alternately each time a signal is received from a switch 114 which is cloed upon depression of the start-stop button 60. Thus, the drive motor 104 is turned on when the start-stop button 60 is depressed, and turned off when the button 60 is again depressed. The drive motor 104 is also turned off when the flip-flop 96 is placed in the RESET state upon application of the previously stated END CODE signal BE, which causes the flip-flop 96 to stop its output of the MOTOR START signal SK.

The operation of the instant preferred embodiment of the sewing machine will be described below.

Upon selecting a stitch pattern other than the buttonhole patterns through depression of the pattern selecting button 58, the PATTERN CODE signal SM representing the selected stitch pattern is fed to the start address memory 66. In response to the signal SM, the start address memory 66 generates the START ADDRESS signal SAS1 which represents the start address to retrieve a group of stitch data corresponding to the selected stitch pattern. This START ADDRESS signal SAS1 is applied to the address counter 74 via the multiplexor 70. In this case where the selected stitch pattern is not any one of the buttonhole patterns, no BUTTONHOLE SELECTION signal PTS is presented by the pattern selecting circuit 64 and therefore the port P1 is selected in the multiplexor 70, whereby the START ADDRESS signal SAS1 is allowed to pass through the multiplexor 70 and the buttonhole controlliing circuit 68 is held inoperative.

With the start-stop button 60 depressed in the above condition, the MOTOR START signal SK is produced by the flip-flop 96 and the drive motor 104 is started. As a result, the machine spindle not shown is started to rotate, and the machine initiates a sewing cycle to form stitches on the work fabric through the stitch forming instrumentalities including the needle 22 and the feed dog 26 operatively connected to the machine spindle.

During the sewing cycle, the TIMING signals TP are generated in synchronization with the rotation of the machine spindle.

The address counter 74 adds the number of the received TIMING signals TP to a value of the START ADDRESS signal SAS1 and produces the ADDRESS signals AD to address the ROM 78. The group of stitch data for the selected stitch pattern is sequentially supplied from the ROM 78 to the D/A converters 80 and 82 according to the ADDRESS signals AD. In consequence, the bight actuator 18 and the feed actuator 24 are driven in timed relation with the rotation of the machine spindle, and thus the selected stitch pattern is formed on the work fabric according to the group of stitch data. When an end data stored at the end of the group of stitch data is generated, the START ADDRESS signal SAS1 is again applied to the address counter 74, and the same stitch pattern is formed.

In the case where a buttonhole pattern is selected through depression of the pattern selecting button 58, the BUTTONHOLE SELECTION signal PTS is generated and the input port P2 is selected in the multiplexor 70. As a result, the START ADDRESS signal SAS2 from the start address memory 90 is allowed to pass through the multiplexor 70 and the buttonhole controlling circuit 68 is made operative. Upon reception of the PATTERN CODE signal SM, the buttonhole controlling circuit 68 judges as to the kind of a buttonhole pattern represented by the signal SM, that is, as to which one of the three buttonhole patterns is represented by the PATTERN CODE signal SM.

Figure 4:
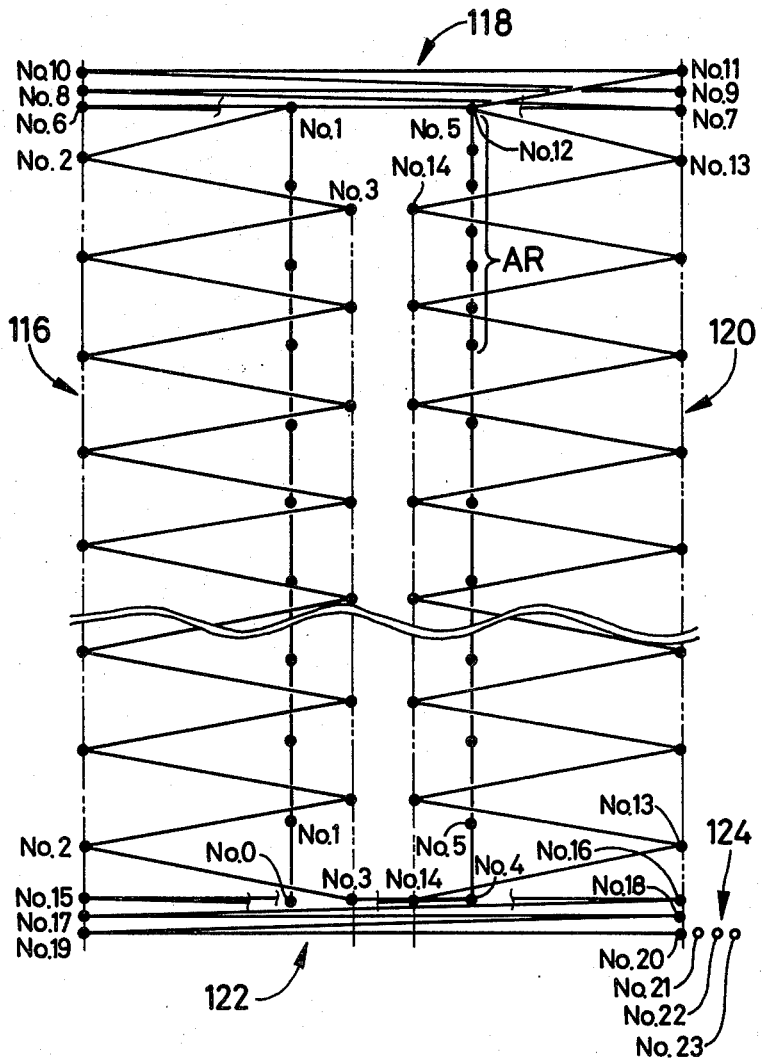
FIGS. 4 through 6 are views representing exemplary buttonhole patterns sewn on the sewing machine of FIG. 1.

The following description refers to a sewing operation when the first buttonhole pattern is selected, i.e., when the selected buttonhole pattern is rectangular as illustrated in FIG. 4.

At first, the drive motor 104 is started to rotate the machine spindle and initiate a first sewing step wherein a stitch No. 0 is first formed and the stitch No. 0 is followed by a multiplicity of stitches No. 1 which are formed in a line until the REAR END signal RT is generated. More specifically stated, the buttonhole controlling circuit 68 initially produces signals for forming the stitch No. 0, which signals are applied to the address counter 74 through the multiplexor 70. Consequently, the stitch data representing the position of the stitch No. 0 is read out from the ROM 78. Following the formation of the stitch No. 0, the signals for the stitches No. 1 are generated from the buttonhole controlling circuit 68 in synchronization with the next TIMING signal TP, and applied to the address counter 74, whereby the stitch data representing the position of the first one of the stitches No. 1 is retrieved from the ROM 78 and the first one of the stitches No. 1 is formed. Each of the stitch data includes end data which causes the start address memory 90 to apply its output signal to the address counter 74. Thus, the stitch data representing the successive stitches No. 1 are sequentially retrieved to form the multiple stitches No. 1.

With the REAR END signal RT fed from the paddle switch 30 to the buttonhole controlling circuit 68, the first step is terminated and a second step is initiated. It is noted that during the first step of the buttonhole sewing cycle, the signal S13 from the buttonhole controlling circuit 68 is applied to the AND gate 92 while the FEED CHANGE signal SC from the AND gate 94 is absent. In this condition, the TIMING signals TP are fed to the counter 72 through the AND gate 92. Since the signal S3 indicative of the execution of the third step is not fed to the counter 72 from the buttonhole controlling circuit 68, the counter 72 counts up the TIMING signals TP which have been generated in the first step. In other words, the number of the stitches which have been formed in the first step is counted by the counter 72.

In the second step, zigzag stitches Nos. 2 and 3 are formed in the direction opposite to the stitching direction of the first step, whereby a left side stitching part 116 is stitched. Stated in more detail, the application of the REAR END signal RT to the buttonhole controlling circuit 68 will signal the start address memory 90 to produce an output of the START ADDRESS signal SAS2 which designates the first one of two addresses corresponding to respective stitch data for the stitches Nos. 2 and 3. As a result, the stitch data for the stitches Nos. 2 and 3 are produced successively with the START ADDRESS signals SAS2 repeatedly applied to the address counter device 74 by means of the end data included in each of the stitch data. When the FRONT END signal FT from the paddle switch 30 is applied to the buttonhole controlling circuit 68, the second step is terminated and the third step is initiated.

In the third step, stitches Nos. 4 and 5 are formed in a line in the same manner as in the first step, in parallel to the line of the stitches Nos. 0 and 1 formed in the first step, until the REAR END signal RT is generated.

During formation of the stitches No. 5 in the third step, the signal S13 indicating the execution of the first or third step is generated from the buttonhole controlling circuit 68, and consequently the TIMING signals TP are supplied to the counter 72. In the meantime, the signal S3 indicating the execution of the third step is generated from the buttonhole controlling circuit 68. Therefore, each time the counter 72 receives the TIMING signal TP one count is subtracted from the number of the stitches of the first step which was counted by the counter 72 in the first step. A STITCH NUMBER COUNT signal NN which represents the current count of the counter 72 is fed to the comparator 100 which has been fed with a STITCH NUMBER SET signal SS indicative of a desired number of stitches, for example, "4". In this instance, therefore, the COINCIDENCE signal SI is applied from the comparator 100 to the AND gate 94 when the content or the current count of the counter 72 has been reduced to the value "4". Since the AND gate 94 has already received the signal S3, the application of the COINCIDENCE signal SI to the AND gate 94 will cause the gate 94 to generate the FEED CHANGE signal SC which is fed to the AND gate 92 via the inverter 98, thereby preventing the entry of the TIMING signals TP into the counter 72. The FEED CHANGE signal SC is also fed to the analog switch 86 whereby the output of the voltage divider 88 is applied to the actuator control circuit 84. As a result, for forming the seven stitches (indicated at AR) as counted from the last stich of the third step, the value of the FEED signal SFA which is the output of the D/A converter 82 is reduced to a substantially half value before it is fed to the actuator control circuit 84. Thus, the operating angle of the feed adjuster driven by the feed actuator 24 is reduced from a level before the FEED CHANGE signal SC is generated, so that the feed increment of the work material is substantially half of the preset nominal or reference value. With this arrangement, the paddle switch 30 is acutated by the trip dog 38 after the incremental feed amount of the work material, i.e., the work feeding rate or speed has been substantially reduced at a position close to the end of the third step. This reduction in the feed rate contributes to a considerable reduction in variation in the actuating position of the position detecting paddle switch 30 due to tendencies of shrinkage of the work material and overrunning of the work engaging shoe 36. Stated in the other way, the reduced feed increment or pitch will minimize the possible difference in the position of the last stitch between the first and third steps as viewed in the work feeding direction. This will lead to substantial elimination of a positional discrepancy between a rear bar tacking part 118 formed in the following fourth step and a right side stitching part 120 formed in the third and fifth steps, and the left side stitching part 116 which has been formed in the first and second steps.

After completion of the third step, a fourth step is initiated to form the rear bar tacking part 118. More particularly, signals for forming stitches Nos. 6 through 12 are generated from the buttonhole controlling circuit 68 in synchronization with the TIMING signals TP, and applied to the start address memory 90 which produces the START ADDRESS signals SAS2 corresponding to those stitches Nos. 6–12. The signals SAS2 are sequentially applied to the ROM 78 through the multiplexor 70 and the address counter 74, so that the stitch data repesenting the stitches Nos. 6–12 are sequentially retrieved from the ROM 78 in synchronization with the TIMING signals TP.

The fourth step is followed by a fifth step wherein the right side stitching part 120 is sewn in the same manner as in the second step. At first, the START ADDRESS signal SAS2 representing the start address corresponding to the stitch data for a stitch No. 13 is generated from the start address memory 90 and the stitch No. 13 is formed. In response to the next TIMING signal TP, the address counter 74 designates the next address to retrieve the stitch data for a stitch No. 14, whereby the stitch No. 14 is formed. The stitch data for the stitch No. 14 includes end data which causes the START ADDRESS signal SAS2 to be applied again to the address counter 74. Therefore, the stitches Nos. 13 and 14 are formed repeatedly until the previously indicated FRONT END signal FT is presented.

When the FRONT END signal FT has been applied to the buttonhole controlling circuit 68, the START ADDRESS signals SAS2 corresponding to stitches Nos. 15–20 are sequentially applied to the start address memory 90 in synchronization with the TIMING signals TP. Thus, in the next sixth step, the group of stitches Nos. 15–20, i.e., a front bar tacking part 122 is formed in the same manner as in the fourth step. The address memory 90 is provided with signals fed from the buttonhole controlling circuit 68 in synchronization with the TIMING signals TP, so that the ADDRESS signals SAS2 to retrieve the stitch data corresponding to the stitches Nos. 15–20 are fed to the ROM 78m through the address counter 74 and the multiplexor 70. Thus, the stitches Nos. 15–20 are produced. After completion of the sixth step, the buttonhole controlling circuit 68 repeats to signal the start address memory 90 to supply the ROM 78 with the START ADDRESS signal SAS2 which corresponds to the stitches Nos. 21–23. Thus, in this seventh step, a back stitching part 124 is formed of the stitches Nos. 21–23.

As soon as the seventh step has been terminated, the buttonhole controlling circuit 68 presents the END CODE signal BE to the T flip-flop 96 to reset the same. Accordingly, the MOTOR START signal SK which has been applied to the speed control circuit 110 is cut and the drive motor 104 is automatically turned off.

It is noted that the left and right side stitching parts 116 and 120 are sewn in the first and second steps and in the third and fifth steps, respectively. Further, attention is directed to the fact that the lengths of the side stitching parts 116, 120 are determined by the lengths of the lines of stitches formed in the first and third steps, respectively.

As described hereinbefore in association with the preferred embodiment, the feed increment of the work material is reduced at a point some stitches before the end of the third step, with a result of a decreased work feeding speed which leads to prevention or minimization of a variation in the actuating position of the detector paddle switch 30 caused by the tendencies of the work fabric to shrink and of the shoe 36 to overrun. This means a considerable reduction in deviation in the last stitch position of the third step relative to that of the first step. Furthermore, such deviation if any, can be held within a range of the feed increment which is relatively small. Therefore, the rear bar tacking part 118 contiguous to the right side stitching part 120 is coordinated with the rear end of the left side stitching part 116, with least positioning error with respect to each other, thereby the buttonhole is sewn with a symmetrical, balanced appearance with high reproducibility.

Other preferred embodiments of the present invention will be described below.

Figure 5:
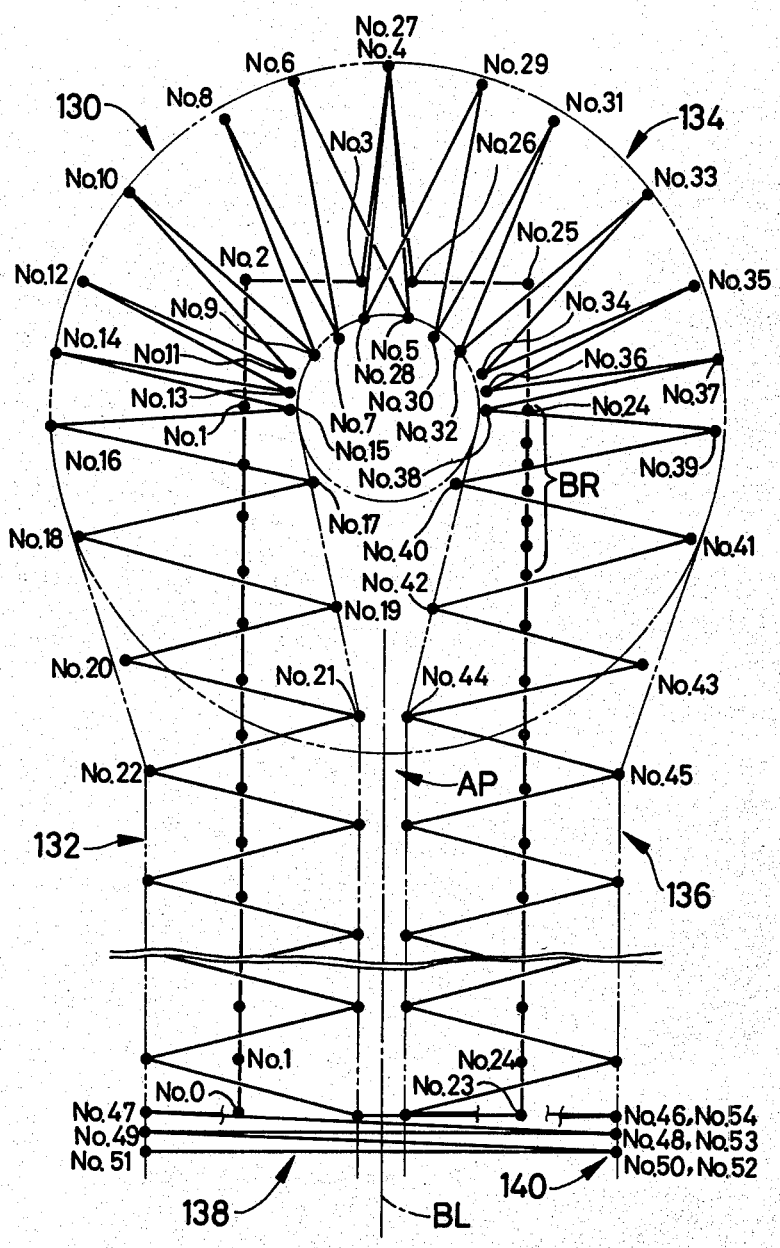

While the preceding embodiment is associated with a buttonhole of a rectangular configuration, the present invention is also applicable to the formation of the second buttonhole pattern as illustrated in FIG. 5. In this instance, there is provided an elongate section AP of a small width which defines a cutting space left unsewn to form a buttonhole slit. In two spaced-apart areas on respective right and left sides of a longitudinal centerline BL of the elongate section AP, there are disposed two side zigzag stitching parts 132, 136, respectively, which are symmetrical to each other with respect to the centerline BL and extend along the same. The two left and right side zigzag stitching parts 132, 136 terminate at one end thereof in a bar tacking part 138 such that the parts 132, 136 are connected by the bar tacking part 138. At the other end of the side stitching parts 132, 136, they are connected to left and right semicircular stitching parts 130 and 134 respectively. Thus, the second buttonhole is formed by the two side zigzag stitching parts 132, 136, bar tacking part 138, semicircular stitching parts 130, 134, and back stitching part 140.

In forming this second buttonhole accordoing to the invention, a first step is performed to produce a stitch No. 0, and then a line of plural successive stitches No. 1 with a predetermined feed increment until the rear end of the left side zigzag stitching part 132 is detected. In other words, the stitches Nos. 0 and 1 are formed in a straight line without bight displacements.

When the rear end of the left side zigzag stitching part 132 is detected by the paddle switch 30 and the REAR END signal RT is fed to the buttonhole controlling circuit 68, a second step is conducted, whereby a stitch No. 2 is formed on a line of extension from the line of said straight stitches, and the stitch No. 2 is followed by a stitch No. 3 which is positioned on a line perpendicular to the above extension line and close to the centerline BL. Then, the stitch No. 3 is followed by a stitch No. 4 which is located on the centerline BL and on the outer circumference of the left semicircular stitching part 130. Further, the stitch No. 4 is followed by a stitch No. 5 which is formed on the other side of the centerline BL and on the inner circumference of the right semicircular stitching part 134.

Then, in a third step, stitches Nos. 6 through 15 are produced to form the left semicircular stitching part 130 in said one of the two areas. Successively, stitches Nos. 16 through 22 are generated to complete the left side zigzag stitching part 132. Thus, these stitches Nos. 6 through 22 constitute the left semicircular stitching part 130 and the left side zigzag stitching part 132 contiguous to the former. The stitches Nos. 21–22 are repeatedly formed according to corresponding stitch position data until the front end of the left side zigzag stitching part 132 is detected, so that the zigzag stitching part 132 of multiple stitches extend along the centerline BL of the buttonhole.

When the front end of the left side zigzag stitching part 132 is detected by the paddle switch 30 and the FRONT END signal FT is fed to the buttonhole controlling circuit 68, a fourth step is initiated, whereby a stitch No. 23 and the following multiple stitches No. 24 which are symmetrical to the stitches Nos. 0 and 1 of the first step with respect to the centerline BL, are produced in the similar manner until the rear end of the zigzag stitching part 130 is detected. For forming the seven stitches (indicated at BR) as counted from the last stitch of the fourth step, the feed increment of the work material is reduced to a substantially half of the preset nominal reference value, that is, the work feeding speed is reduced before the fourth step comes to an end. With this arrangement, the deviation of the last stitch position of the fourth step from that of the first step in the work feeding direction is greatly decreased as in the previous embodiment.

In the following fifth step, stitches Nos. 25—28 are formed at positions symmetrical to the stitches Nos. 2–5 of the second step with respect to the centerline BL. It is noted that the stitch No. 28 which is formed prior to the sewing of the right semicircular stitching part 134, is located in the already sewn left semicircular stitching part 130 in said one area.

Successively, a sixth step is implemented wherein stitches Nos. 29–45 are generated to form the left semicircular stitching part 134 and the right side zigzag stitching part 136 which are symmetrical to the left semicircular stitching part 130 and the left side zigzag stitching part 132 of the previously described third step. Then, stitches Nos. 46–51 and Nos. 52–54 are produced, in seventh and eight steps respectively, at the front edges of the side zigzag stitching parts 132 and 136 to form the front bar tacking part 138 connecting the two side zigzag stitching parts 130 and 134, and thus the buttonhole is completed. The stitches Nos. 52, 53 and 54 are back stitches which are formed at the same positions as the stitches Nos. 46, 48 and 50 on one side of the bar tacking part 138, and which constitute a back stitching part 140.

In the same way as used to stitch the second buttonhole discussed above, the third buttonhole as shown in FIG. 6 is sewn in a process which comprises: a first step of forming stitches Nos. 0 and 1; a second step of forming a left side semicircular stitching part 142 consisting of stitches Nos. 2–14; a third step of forming a left side part 144 consisting of stitches Nos. 15 and 16; a fourth step of forming stitches Nos. 17 and 18 wherein the sewing speed is reduced near the end of the step; a fifth step of forming a right side semicircular stitching part 146 consisting of stitches Nos. 19 and 31; a sixth step of forming a right side stitching part 148 consisting of stitches Nos. 32 and 33; a seventh step of forming a front bar tacking part 150 consisting of stitches Nos. 34–39; and an eighth step of forming a back stitching part 152 consisting of stitches Nos. 40–42. It is noted that the work feeding increment, i.e., the work feeding speed is reduced to a substantially half value for the four stitches (indicated at CR) as counted from the last stitch position of the fourth step, whereby an improvement in the sewing accuracy as sought in the previous embodiments is obtained.

Figure 6:
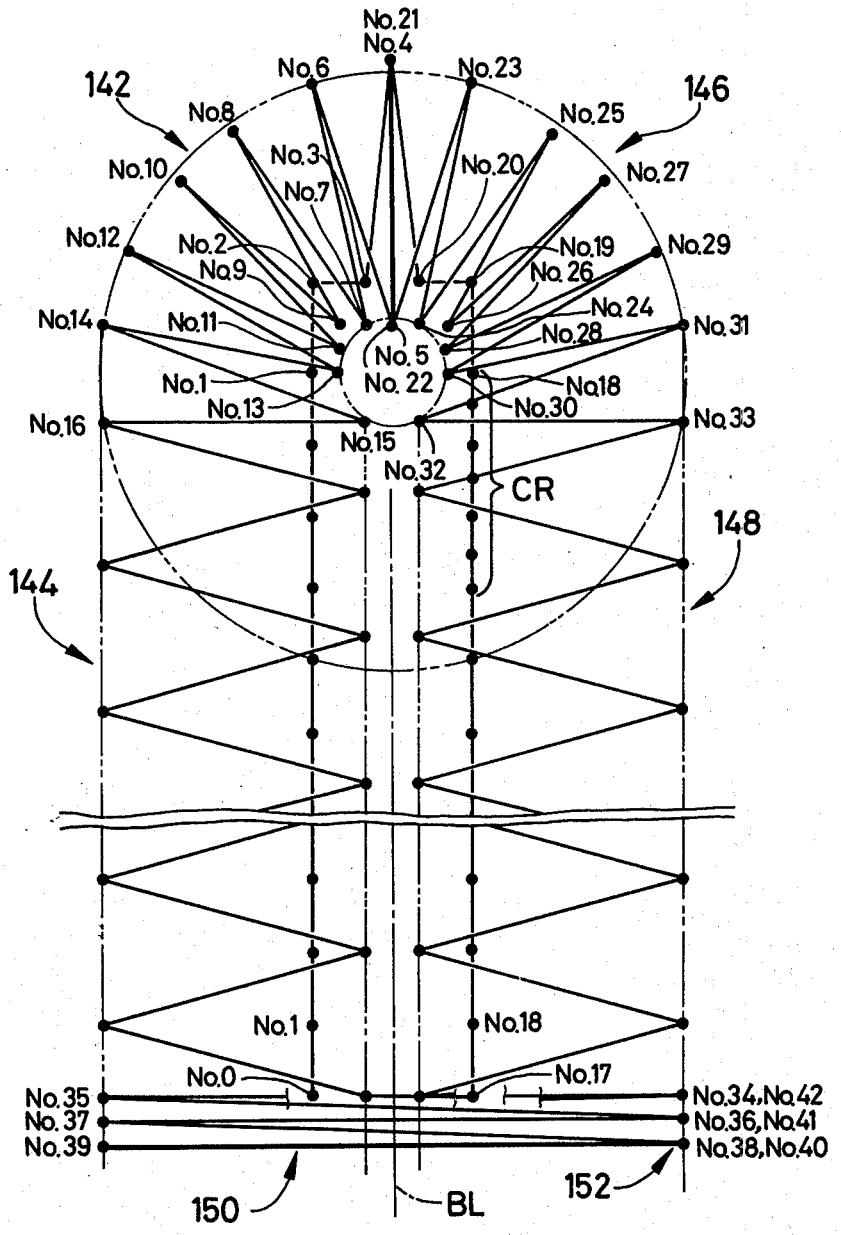

As described above in connection with the second and third buttonhole patterns shown in FIGS. 5 and 6, the work material is fed in the same direction for the first and fourth steps of sewing the lines of straight stitches whose lengths are determined through detection of a preset position on the work material by the paddle switch 30, and for the third and sixth steps of sewing the side zigzag stitching parts and the semicircular stitching parts. In this sewing method, the stitches on both right and left sides of the centerline BL are formed under the same work feeding conditions, i.e., with the same feeding efficiencies. Thus, a substantially equal number of stitches are produced (the same stitch density is obtained) in both right and left stitching areas which are symmetrical to each other with respect to the centerline BL of the buttonhole, and thus a good balance is maintained between the two stitching areas.

A further advantage is found in the second and fourth steps wherein at least one stitch is formed in one of the two semicircular stitching parts in one of the two stitching areas on the right and left sides of the centerline BL before the other semicircular stitching part is sewn. This arrangement causes the right and left semicircular stitching parts to be connected to each other by the threads which cross the centerline BL and thereby reinforce the connection or interface of the two semicircular stitching parts in the direction towards each other. Thus, the right and left semicircular stitching parts which are formed in different steps and otherwise tend to shrink due to tensile forces of the threads, are protect3ed against separation from each other and consequent development of a gap at the interface or connection of the two parts after they are formed.

In summary, the method according to the present invention assures a balanced stitch density between the two stitching areas on the right and left sides of the centerline BL, and eliminates otherwise possible separation of the right and left semicircular stitching parts from each other, thus providing a buttonhole with an extremely uniform and neat appearance.

While the present invention has been described in its preferred embodiments, it is to be understood that the invention may be embodied in other forms.

For example, in addition to the reduction in the feed increment for a predetermined number of straight stitches as counted from the rear end of the right side zigzag stitching part 120, 136, 148 for a period until the paddle switch 30 is actuated at said rear end, as practiced in the preceding embodiments, it is also possible to reduce the feed increment for a given number of zigzag stitches as counted from the front end of the stitching part 120, 136, 148 for a period until the paddle switch 30 is actuated at the front end. In this instance, the number of zigzag stitches formed in the left side zigzag stitching part 116, 132, 144 is counted, and when the number of zigzag stitches which have been formed in the right side zigzag stitching part 120, 136, 148 has reached a value which is smaller by a predetermined number than the total number of zigzag stitches of the left side stitching part, the feed increment is reduced and the reduced increment is used until the paddle switch 30 has detected the front end of the right side stitching part.

While the counter 72 is adapted to be reset by the BUTTONHOLE SELECTION signal PTS in the previously discussed embodiments, the counter 72 may be reset by the END CODE signal BE or other signals. This alternative arrangement provides an advantage that there is no need to operate the pattern selecting button 58 each time the sewing cycle is repeated to form the same buttonholes successively.

It is also appreciated that a so-called microcomputer be employed to partially or wholly constitute the circuits of the embodiment shown in FIG. 3 except input and output devices such as switches 62 and 114, actuator control circuit 84, motor drive circuit 112, actuators 18 and 24, drive motor 104.

Further, the approximate 50% reduction of the feed increment for the sewing length indicated at AR, BR or CR in the previous embodiments may be changed to a desired value lower or higher than 50%.

It is understood that the foregoing embodiments are given only for illustrating the present invention; various changes and modifications may be made without departing from the spirit and scope of the invention.

What is claimed is:

1. A buttonhole sewing machine having (a) stitch forming instrumentalities including a reciprocable needle and a work feeding mechanism, (b) means operating in timed relation with reciprocation of said needle for producing each of stitch signals corresponding to stitches of a buttonhole including a first and a second side stitching part parallel to and spaced from each other, each of said stitch signals including a reference feed signal influencing a feed increment of said work feeding mechanism, (c) a buttonhole presser device including a button size gauging arrangement, (d) switch means adapted to cooperate with said button size gauging arrangement during formation of said buttonhole, said switch means producing two position signals corresponding to a front and a rear end of each of said side stitching parts to define a longitudinal size of said buttonhole, and (e) means for actuating said stitch forming instrumentalities in response to said stitch signals and said two position signals, said buttonhole sewing machine comprising:

means for generating a modified feed signal representative of a feed increment smaller than a feed increment indicated by said reference feed signal related to said side stitching parts;

changeover means operative to change said reference feed signal into said modified feed signal and to provide said actuating means with said modified feed signal;

means for counting first stitches formed in said first side stitching part during a time interval between generations of said two position signals, and then counting second stitches formed in said second side stitching part after generation of one of said two position signals; and control means for generating a coincidence signal when a count of said second stitches of said counting means has become equal to the already counted total number of said first stitches less a predetermined number, and for operating said changeover means during a time interval between generation of said coincidence signal and subsequent generation of the other position signal.

2. A buttonhole sewing machine according to claim 1, wherein said control means includes storage means for storing data indicative of said predetermined number, and means for comparing the count of said counting means with said data to generate said coincidence signal.

3. A buttonhole sewing machine according to claim 1, wherein said counting means comprises a reversible counter which is adapted to count a timing signal synchronous with each reciprocation of said needle.

4. A method of forming a buttonhole including a first and a second side stitching part parallel to and spaced from each other, on a sewing machine having (a) stitch forming instrumentalities including a reciprocable needle and a work feeding mechanism, (b) means operating in timed relation with reciprocation of said needle for producing each of stitch signals corresponding to stitches of said buttonhole, each of said stitch signals including a reference feed signal influencing a feed increment of said work feeding mechanism, (c) a buttonhole pressure device including a button size gauging arrangement, (d) switch means adapted to cooperate with said button size gauging arrangement during formation of said buttonhole, said switch means producing two position signals corresponding to a front and a rear end of each of said side stitching parts to define a longitudinal size of said buttonhole, and (e) means for actuating said stitch forming instrumentalities in response to said stitch signals and said two position signals, said method comprising the steps of:

(1) measuring the first length of said first side stitching part formed during a time interval between generations of said two position signals;

(2) measuring the second length of said second side stitching part formed after generation of one of said two position signals; and (3) providing said actuating means with a modified feed signal in place of said reference feed signal during a time interval from the moment when the second length measured during formation of said second stitching part has become equal to the measured first length less a predetermined length, until the other position signal is produced after the beginning of the time interval, said modified feed signal being indicative of a feed increment smaller than a feed increment indicated by said reference feed signal related to said side stitching parts.

5. A method of forming a buttonhole which includes two zigzag stitching parts in spaced-apart parallel rows of zigzag stitches placed in first and second areas on opposite sides of a longitudinal centerline of the buttonhole pattern, an end stitching part connected to one end of each of said zigzag stitching parts, and a circular stitching part connected to the other end of each of said zigzag stitching parts, said method comprising the steps of:

(a) forming a straight stitching part in a direction from said one end toward said other end in said first area;

(b) forming at least one stitch in one half of said circular stitching part in said second area;

(c) forming the other half of said circular stitching part and one of said zigzag stitching parts connected thereto in said first area;

(d) forming a straight stitching part in said direction in said second area;

(e) forming at least one stitch in said other half of said circular stitching part in said first area; and (f) forming said one half of said circular stitching part and the other of said zigzag stitching parts connected thereto in said second area.

6. A method according to claim 5 further comprising the step of (g) forming, after the step (f), said end stitching part composed of a bar tacking part.

7. A method according to claim 5 further comprising the steps of:

counting the number of first straight stitches formed in the step (a) in said first area;

counting the number of second straight stitches during formation of said straight stitching part in said second area in the step (d);

comparing, during the step (d), the counted total number of said first straight stitches with the number of said second straight stitches which has been counted;

generating a feed change signal when the number of said second straight stitches has become equal to the number of said first straight stitches minus a predetermined number, said feed change signal causing adjustment of a reference feed signal representative of a predetermined feed increment of a work material, and thereby reducing said predetermined feed increment to a lower value for formation of said predetermined number of the second straight stitches which have not been sewn before generation of said feed change signal.

* * * * *